United States Patent [19]

Burley

[11] Patent Number: 4,913,047

[45] Date of Patent: Apr. 3, 1990

[54] ELECTRIC SAUSAGE COOKER

[75] Inventor: Allan L. Burley, Omenee, Canada

[73] Assignee: ADP Technology Inc., Toronto, Canada

[21] Appl. No.: 256,556

[22] Filed: Oct. 12, 1988

[30] Foreign Application Priority Data

Oct. 22, 1987 [GB] United Kingdom ..... 8724771

[51] Int. Cl.[4] ..... A47J 43/18

[52] U.S. Cl. ..... 99/441; 99/337; 99/342; 99/427

[58] Field of Search ..... 99/441, 426, 427, 439, 99/449, 337, 338, 339, 342

[56] References Cited

U.S. PATENT DOCUMENTS

| | | | |
|---|---|---|---|
| 2,052,919 | 9/1936 | Brogdon et al. | 99/337 |
| 2,125,471 | 8/1938 | Nelson | 99/337 |
| 2,274,325 | 2/1942 | Ford | 99/337 X |
| 2,889,765 | 6/1959 | Yetter | 99/337 |
| 2,895,405 | 7/1959 | Hopkins | 99/337 X |
| 2,980,010 | 4/1961 | Williams | 99/337 |
| 3,974,358 | 8/1976 | Goltos | 99/374 |
| 4,025,299 | 5/1977 | Dubois | 99/373 X |
| 4,639,577 | 1/1987 | Sturdevant | 219/392 X |

*Primary Examiner*—Stephen Marcus
*Assistant Examiner*—Christine A. Peterson
*Attorney, Agent, or Firm*—Shoemaker and Mattare, Ltd.

[57] ABSTRACT

An electric sausage cooker defines troughs in which sausages or the like can be placed to restrain them against the lateral deflection when axially compressed. The standard wall voltage is then applied across the sausage through two contact plates. One of the plates is movable and the other is fixed. A safety feature is incorporated, by the provision of a lid which closes over the sausages and prevents the user from touching the contact plates. As the lid swings shut, it mechanically closes a safety switch, which in turn activates the contact plates. When the lid opens the contact plates are de-activated.

4 Claims, 7 Drawing Sheets

ELECTRIC SAUSAGE COOKER

This invention relates generally to a cooker adapted to cook frankfurters, sausages, and similar elongated meat products. More particularly, this invention provides a unique, light-weight construction which is adapted to cook these items electrically by passing a current through the frankfurters, etc., whereby the internal resistance of the frankfurter itself causes the generation of sufficient heat to cook the meet.

BACKGROUND OF THIS INVENTION

It is not new to utilize the internal resistance of a frankfurter or the like to cook the frankfurter by passing an electric current through it. Representative prior patents, all of them issued in the United States, are as follows:

U.S. Pat. No. 1,974,715 issued Sept. 25, 1934 to S. Kohn,

U.S. Pat. No. 1,993,353 issued Mar. 5, 1935 to R. H. Young,

U.S. Pat. No. 1,994,894 issued Mar. 19, 1935 to A. G. Marcotte,

U.S. Pat. No. 2,022,940 issued Dec. 13, 1935 to V. J. Persiani,

U.S. Pat. No. 2,052,919 issued Sept. 1, 1936 to J. C. Brogdon et al,

U.S. Pat. No. 2,094,814 issued Oct. 5, 1937 to R. Pool,

U.S. Pat. No. 2,139,690 issued Dec. 13, 1938 to S. V. McConnell et al,

U.S. Pat. No. 2,345,049 issued Mar. 28, 1944 to G. W. Hunter,

U.S. Pat. No. 2,621,587 issued Dec. 16, 1952 to M. Savio,

U.S. Pat. No. 2,776,358 issued Jan. 1, 1957 to M. T. Sturr,

U.S. Pat. No. 2,895,405 issued July 21, 1959 to R. E. Hopkins,

U.S. Pat. No. 2,951,433 issued Sept. 6, 1960 to C. H. Steuber et al,

U.S. Pat. No. 2,980,010 issued Apr. 18, 1961 to B. E. Williams,

U.S. Pat. No. 2,986,991 issued June 6, 1961 to L. E. Yetter,

U.S. Pat. No. 3,948,159 issued Apr. 6, 1976 to K. B. Vigerstrom,

U.S. Pat. No. 3,966,972 issued June 29, 1976 to E. T. Theimer, et al

Despite the disclosures of the prior art, however, there is a need for a compact, light-weight cooker for frankfurters and the like which is reliable and can readily accommodate items of different lengths.

More particularly, it is highly desirable to provide a safety feature whereby electric current is applied to the probes or contacts only when the cooker is closed in such a way that the operator cannot come into contact with the probes.

Further, there is a need for a cooker designed in such a way as to provide an indication as to when these frankfurters, sausages or the like are fully cooked.

The present invention addressed the foregoing desirable characteristics.

GENERAL DESCRIPTION OF THIS INVENTION

Accordingly, this invention provides an electric cooker for sausages and the like, comprising:

a base portion which includes support means for supporting at least one sausage-like item so that the latter is restrained against lateral deflection when axially compressed, said support means being electrically non-conducting, said support means being shaped to define at least one rounded trough into which a sausage-like item can be placed, first electrically conductive contact means adjacent one end of said at least one sausage-like item, second electrically conductive contact means adjacent the other end of said at least one sausage-like item, one of said contact means being movable toward and away from the other, to allow the contact means to simultaneously contact the respective ends of a sausage-like item in the support means, each said conductive contact means being a metallic plate having at least one raised protuberance substantially in axial alignment with said at least one trough, a carriage adapted to reciprocate in a direction aligned with said at least one trough, the movable plate being mounted on said carriage, electrical means for passing electrical current between the two plates through said at least one sausage-like item, thereby heating the item due to the item's internal resistance, an on-off switch connected with said electrical means such that when the switch is off no electrical current can flow between the two plates, and such that when the switch is on current can flow between the two plates;

a lid hinged to the base portion and adapted to swing between an open position and a closed position, the lid being operatively connected with said switch and with one of said plates such that (1) when the lid is in the open position, a sausage-like item may be inserted into or removed from the support means and said switch is off, and (2) when the lid is in the closed position, physical access to a sausage in the support means is prevented and the switch is on, and resilient means biasing the carriage toward the non-movable plate, the lid being operatively connected with said carriage by cam and follower means such that, as the lid moves from its open toward its closed position, the carriage is permitted to move toward the non-movable plate under the urging of the spring means, to achieve a final position dependent upon the length of the sausage-like item, and as the lid moves from its closed toward its open position, the carriage is retracted away from the non-movable plate against the urging of said spring means.

GENERAL DESCRIPTION OF THE DRAWINGS

Two embodiments of this invention are illustrated in the accompanying drawings, in which like numerals denote like parts throughout the several view, and in which.

DETAILED DESCRIPTION OF THE DRAWINGS

Figure 1:
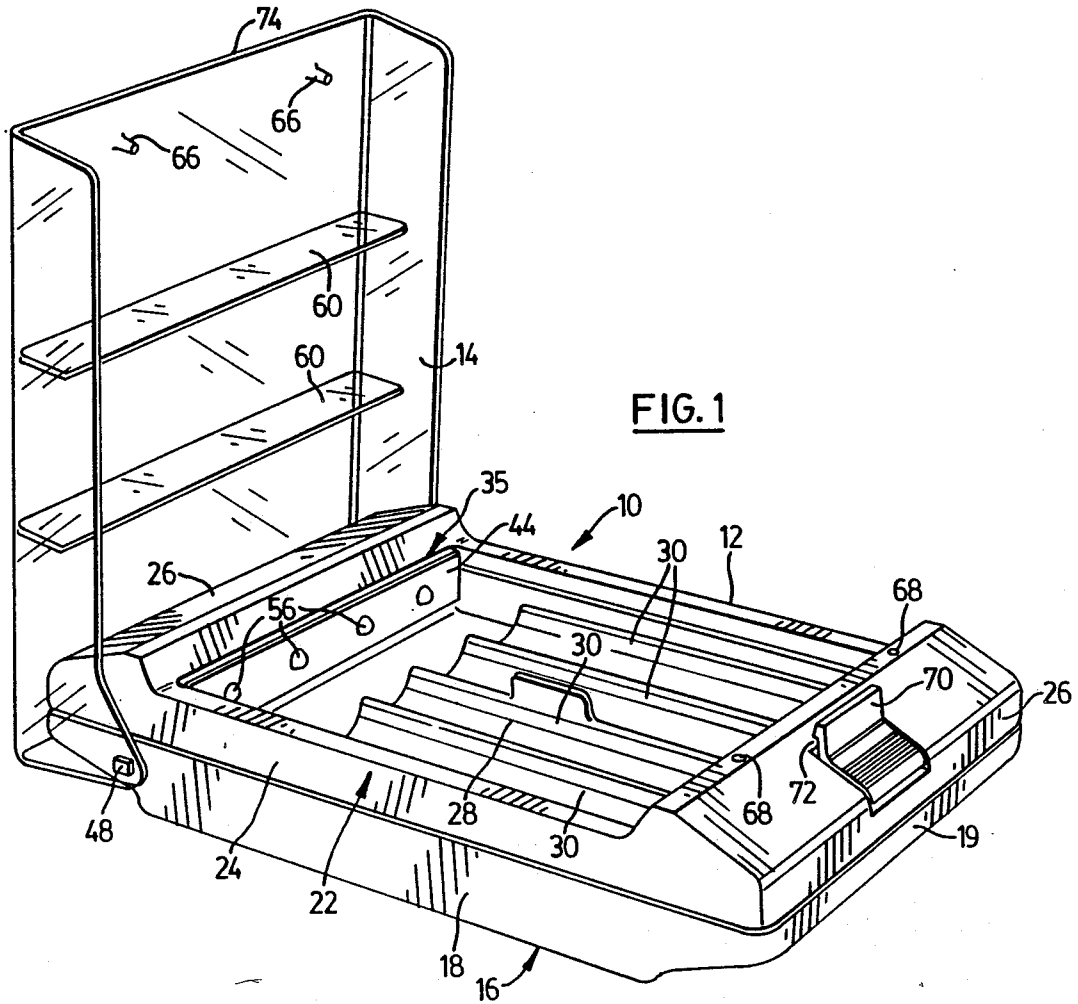
FIG. 1 is a perspective view of a sausage cooker built in accordance with one embodiment of this invention, in the open position.

Attention is first directed to FIG. 1, in which one embodiment of the cooker 10 of this invention is seen to include a base 12 and a lid 14. The base 12 has a lower molding 16 defining a bottom wall 17 and side walls 18, as well as end portions 19. The base 12 further includes an integral upper molding 22 having side portions 24, end portions 26 and an internal wall 28 having a washboard configuration defining a plurality (four in this case) of longitudinally extending, side by side channels 30. The washboard construction is located only in the intermediate portion of the upper molding, the latter including flat end portions 32, as can be seen in FIG. 2.

The upper molding 22 defines an opening 35 which is elongated across the unit, as seen in FIG. 1. Within the opening 35 is slidably mounted a carriage 36 which has a top wall 38, a bottom wall 40, a forward wall 42, and two side walls (not seen). Secured to the forward wall 42 is an electrical contact plate 44. Two compression coil springs 46 are mounted between the walls 38 and 40, and each has one end pressing rightwardly on the wall 42, and the other end pressing leftwardly within the end portions 19 and 26 as pictured at the left in FIG. 2.

The lid is pivoted with respect to the base 12. Specifically, the lid has two rectangular openings which engage square sections in the ends of an axle 48 which serves as a pivot. The axle 48 also has two arms 50 (seen in broken lines in FIG. 2) which support short, transverse pins 49 at their inner ends (the ends remote from the axle 48). The pins engage external upright bars which are integral with the side walls of the carriage 36.

Figure 2:
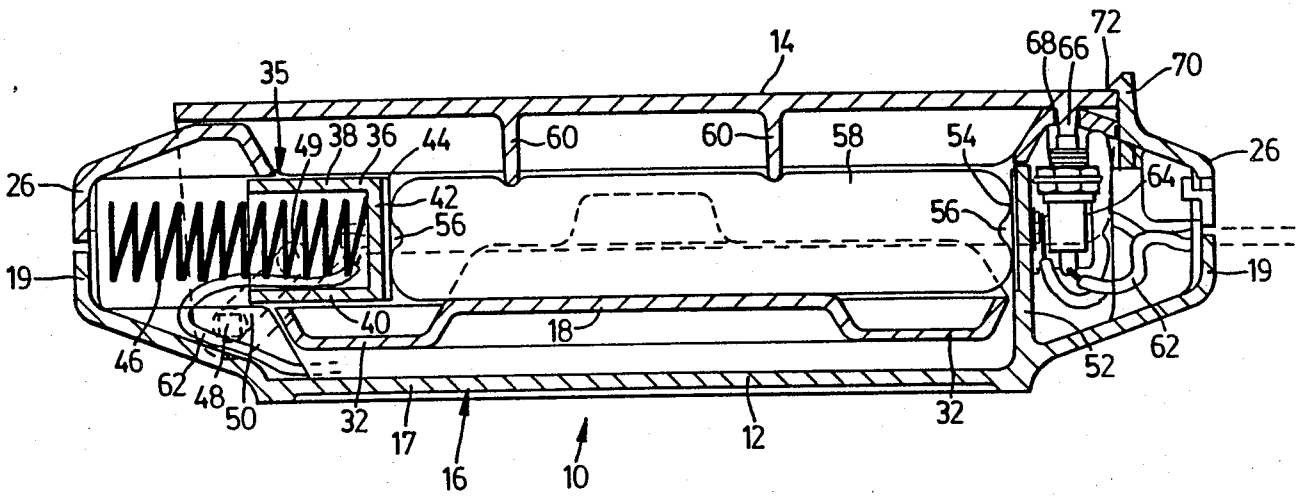
FIG. 2 is a vertical longitudinal sectional view through the cooker of FIG. 1, in the closed position.

The pivoting action of lifting the lid 14 turns the axle 48, swinging the arms 50 counter-clockwise with respect to FIG. 2, and pulling the carriage 36 and the contact plate 44 back away from the frankfurters (leftwardly) against the action of the springs 46. Swinging the lid 14 closed allows the spring action of the springs 46 to push the carriage 36 and the movable contact plate 44 rightwardly against the pins at the ends of the arms 50. However, if the length of the frankfurters is such that it prevents full forward movement, the arms 50 will pivot freely, while the movable contact plate 44 is held against the frankfurters by spring pressure.

As seen at the right in FIG. 2, the lower molding 16 includes an upstanding transverse wall 52 to which is secured a stationary contact plate 54. Each of the contact plates 54 and 44 have protuberances 56 to enable the respective plates to make good electrical contact with a frankfurter or the like 58 which is received in one of the channels 30.

The lid 14 has transverse reinforcing webs 60 which not only strengthen the lid, but also act to retain the frankfurters within the channels 30.

As can be seen in FIG. 2, the plates 44 and 54 are in contact with electrical wires 62, and would be connected directly across a 120 volt service. A safety feature is provided in the form of a switch 64 which is activated only when protrusions 66 adjacent the free end of the lid 14 enter openings 68, one of the protrusions 66 pressing downwardly on the contact of the switch 64.

A latch 70 is provided to retain the lid 14 in the closed position, the latch being toggle mounted and having an undercut lip 72 which is adapted to engage above the free edge 74 of the lid 14.

It will thus be appreciated that the plates 44 and 54 are energized only after the lid 14 has been closed, thereby eliminating any risk of electrical shock to the user.

Figure 3:
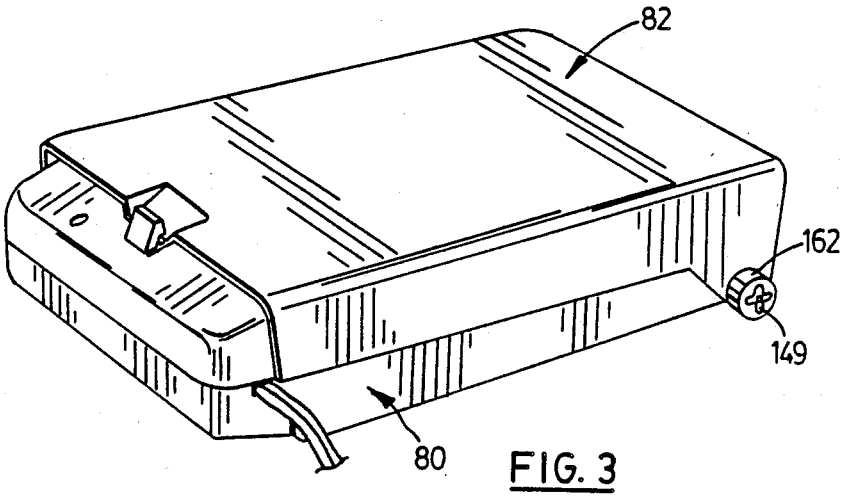
FIG. 3 is a perspective view of the second embodiment of this invention, in the closed position.
Figure 4:
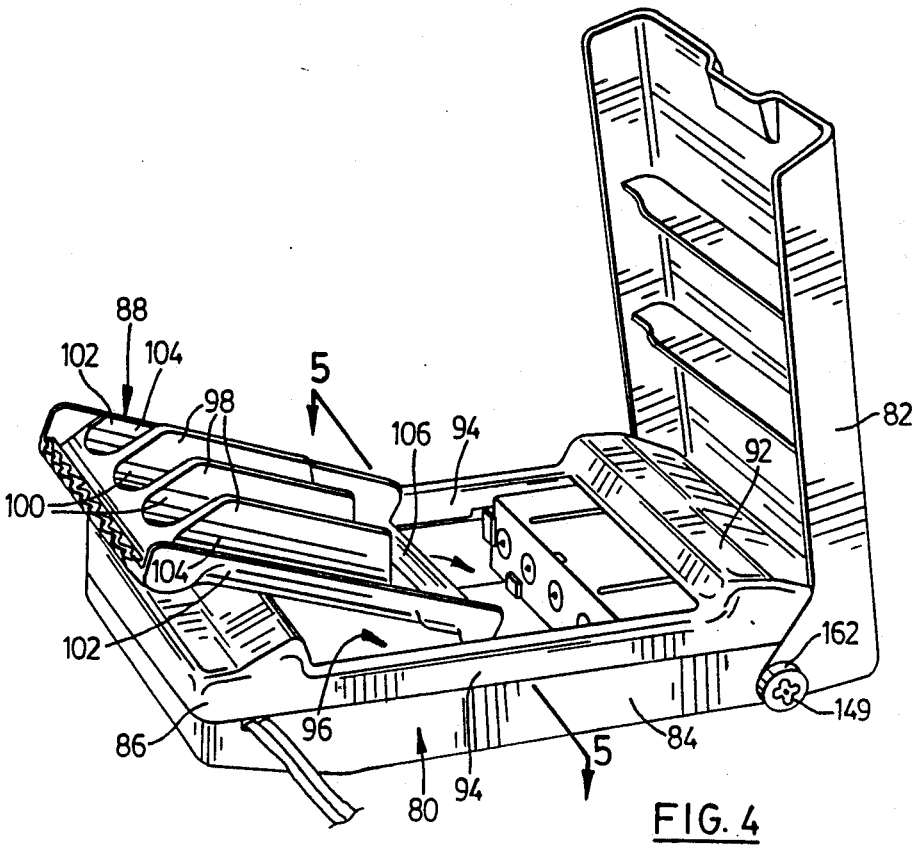
FIG. 4 is a perspective view of the cooker of FIG. 3, in the open position and with one of the components partly withdrawn.

Attention is now directed to FIGS. 3 and 4, which illustrate closed and open positions of the second embodiment of this invention. The drawings illustrate a cooker for sausages and the like, which incorporates a base portion 80 and a lid 82.

As seen in FIG. 4, the base 80 consists of three components. The first component is a bottom molding 84, and the second is a top molding 86 which interfits with the bottom molding 84 as can be seen in FIG. 4. The third component is a guide member 88 which constitutes support means for the sausages and the like. More particularly, the guide member 88 is shaped to define four rounded, aligned troughs, into each of which a sausage-like item can be placed such that it is restrained against the lateral deflection. All of the components 84, 86 and 88 are preferably of plastic or other non-electrically conducting material.

It will be noted that the top molding 86 defines a forward cover part 90 and a rearward cover part 92, which are integral along two side parts 94. The side parts 94 are spaced apart along the lateral edges of the base 80, and the forward and rearward cover parts 90 and 92 are also spaced apart. Thus is defined a rectangular opening 96 into which the guide member 88 can be fitted. The guide member 88 further includes three central, spaced apart partitions 98, which between them define two channels or troughs 100 for the reception of sausage-like items. The guide member 88 further includes two, parallel lateral walls 102 which are shorter in vertical height than the partitions 98, and define with the outermost of the partitions 98 two further troughs 104.

Finally, the guide member 88 is shaped to define a transverse channel 106, the purpose of which is to act as grease-catcher.

It will now be apparent that the first embodiment of this invention, described with respect to FIGS. 1 and 2, incorporates together the guide member 88 and the top molding 94 as a single integral unit. The second embodiment of this invention, illustrated in FIG. 4, has the advantage that the guide member 88 can be readily removed from the remainder of the item, for cleaning purposes.

Figure 5:
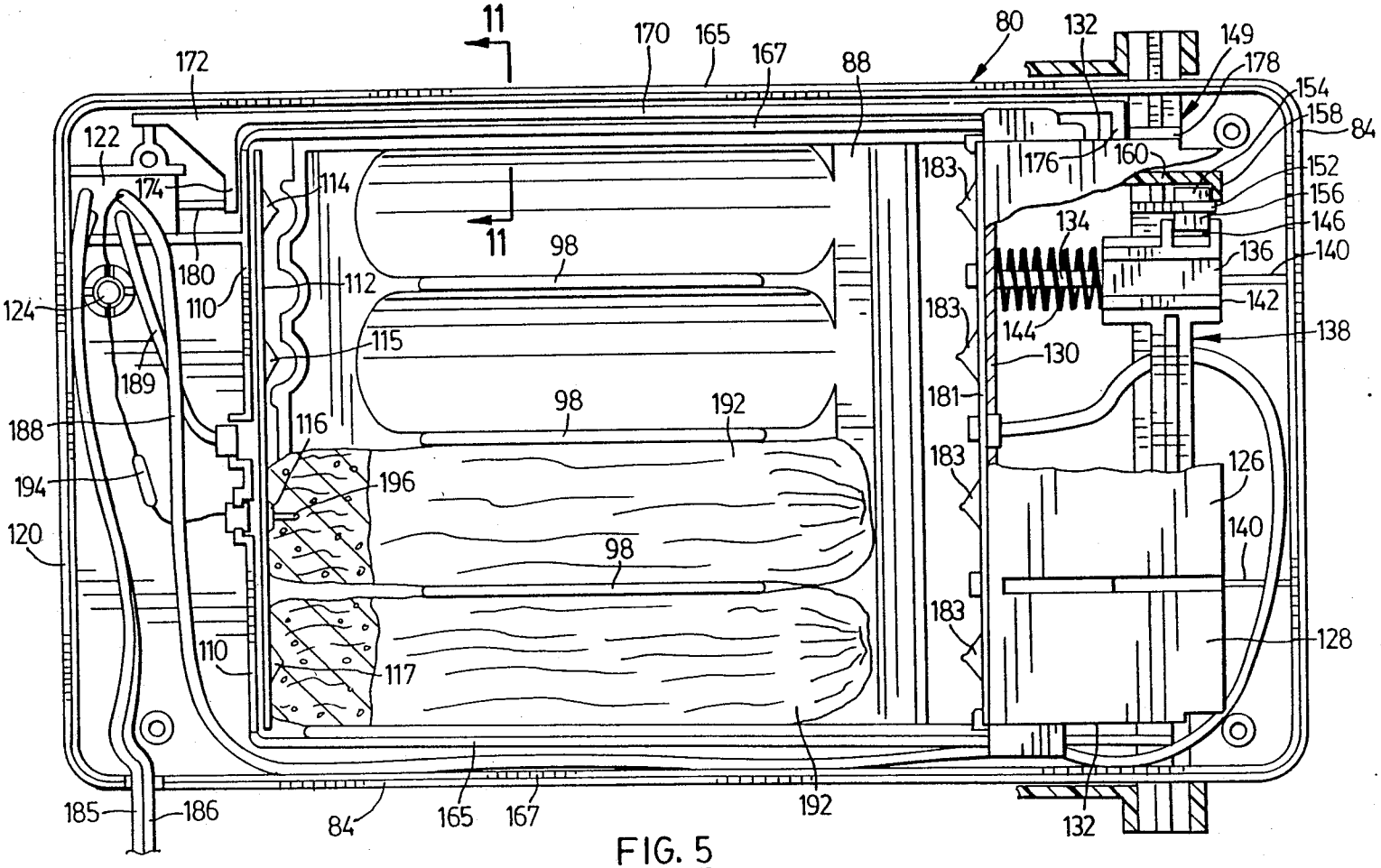
FIG. 5 is a horizontal sectional view through the cooker of FIGS. 3 and 4, showing the internal components of the second embodiment of the cooker, with the lid being open.

As seen in FIG. 5, the bottom molding 84 incorporates an upstanding transverse wall 110, similar to the upstanding wall 52 seen at the right in FIG. 2. This wall 110 acts as a support for an electrically conductive contact plate 112, the latter being provided with four spaced protuberances 114, 115, 116 and 117. The bottom molding 84 has a front wall 120 spaced forwardly from the intermediate wall 110. Between these two walls are located a safety switch 122, a monitor light bulb 124, and appropriate wiring as will later be described in detail.

Figure 6:
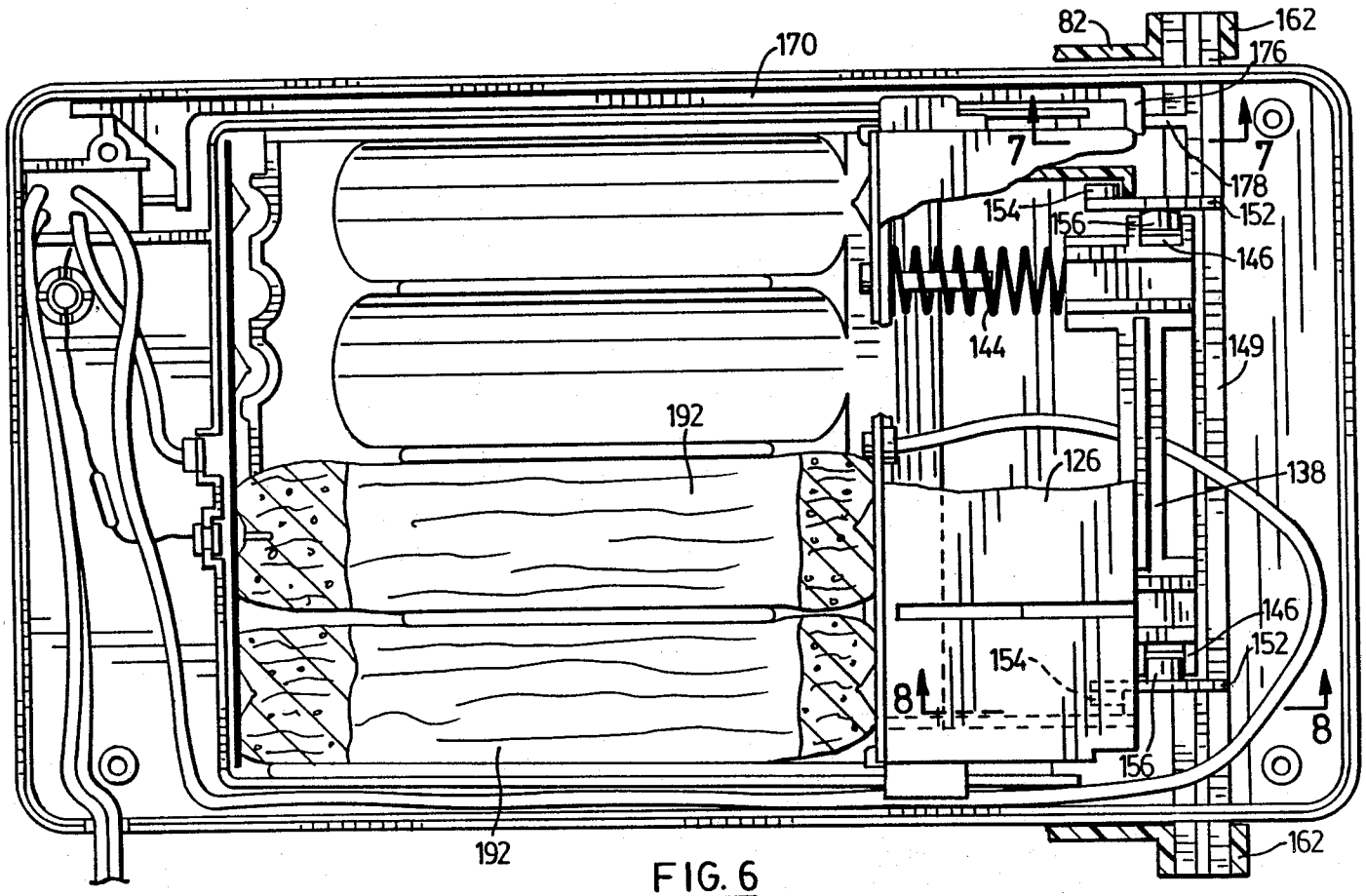
FIG. 6 is a view similar to that of FIG. 5, but with the lid closed.

Attention is now directed to the rightward end of the apparatus shown in FIG. 5 and 6. In FIG. 5, a carriage 126 is shown, partly broken away. More specifically, the carriage 126 has a horizontal top wall 128, a forward wall 130, end walls projecting down under the left and right extremities 132 of the carriage 126 (the side walls not seen), two rearwardly projecting tabs 134 (only one visible in FIG. 5), and means defining two downwardly projecting tracks parallel with the tabs 134 and adapted to be received in corresponding channels 136. A spring holder 138, as pictured in FIG. 5, is slidable in the left-right direction along two webs 140. Further, the spring holder 138 defines two sockets 142 to receive the rightward ends of two coil springs 144. In FIG. 5, only one spring 144 and one socket 142 can be seen. The other spring 144 and socket 142 are hidden by the remaining top wall 128 toward the bottom in FIG. 5.

The spring holder 138 further defines two oppositely laterally opening channels 146 (only one visible in FIG. 5).

Figure 7:
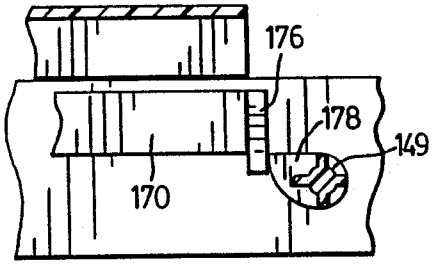
FIG. 7 is a part sectional view taken at the line 7—7 in FIG. 6.

Mounted below the carriage 126 and below the spring holder 138 there is an axle 149 which in section resembles a cross, as seen in FIG. 7. The axle 149 is journaled in suitable circular openings in the bottom molding 84 of the base 80. The axle 149 has two integral arms 152 (only one seen in FIG. 5) which have a dogleg shape, as can be seen in FIGS. 8 and 9.

Both of the arms 152 are seen in FIG. 6. As best seen in FIGS. 8 and 9, each arm 152 supports a laterally outwardly projecting boss 154 at its extremity, and a laterally inwardly projecting boss 156 at an intermediate location.

Figure 9:
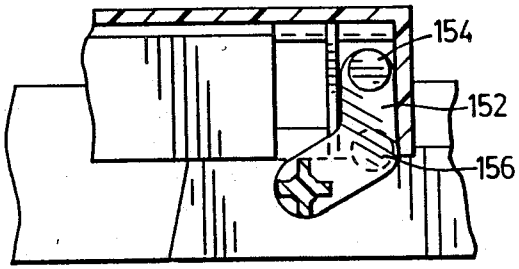
FIGS. 8 and 9 are partial sections taken at the line 8—8 in FIG. 6, and showing the closed and open modes of the cooker.
Figure 8:
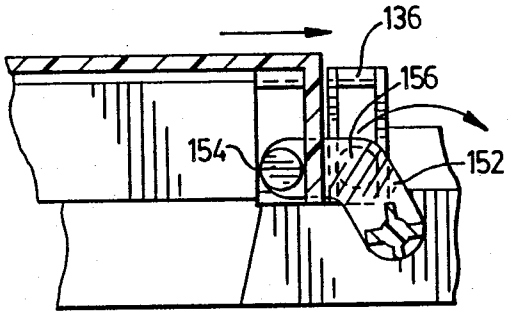

As best seen by comparing FIGS. 6, 8 and 9, the spring holder 138 defines, adjacent each spring socket 142, a channel 146 (already mentioned). Each of the bosses 156 registers in a respective channel 146, such that movement of the arm 152 from the FIG. 9 position to the FIG. 8 position causes the bosses 156 to move the spring holder 136 to the left.

Looking now at FIG. 5, it will be appreciated that the provision of the springs 144 between the spring holder 138 and the forward wall 130 of the carriage 126 causes the carriage 126 always to seek the furthest leftward position with respect to the spring holder 138. However, this action of the springs 144 is counteracted by the fact that the bosses 154 are in a position of mechanical interference with respect to a lip 158 defined at the rightward end of a flange 160 which is an integral part of the carriage 126. Looking now at FIGS. 8 and 9, it will be appreciated that, as the arm 152 swings from the FIG. 9 position to the FIG. 8 position, the bosses 154 at either end of the axle 149 "allow" the carriage 126 to be urged as far as possible to the left by the action of the compression coil springs 144.

The axle 149 registers with, and rotates along with, the lid 82. More specifically, looking at FIGS. 3 and 4, the end portions of the axle 149 register in a cross-shaped aperture in a boss 162, both bosses being integrally formed with the lid 82. Thus, the movement from FIG. 9 to FIG. 8 corresponds to closing the lid 82 from the FIG. 4 position to the FIG. 3 position.

Figure 11:
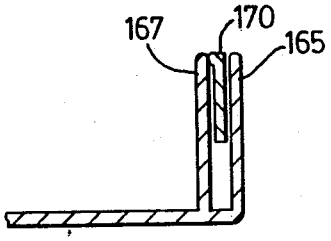
FIG. 11 is a vertical sectional view taken along line 11—11 of FIG. 5.
Figure 10:
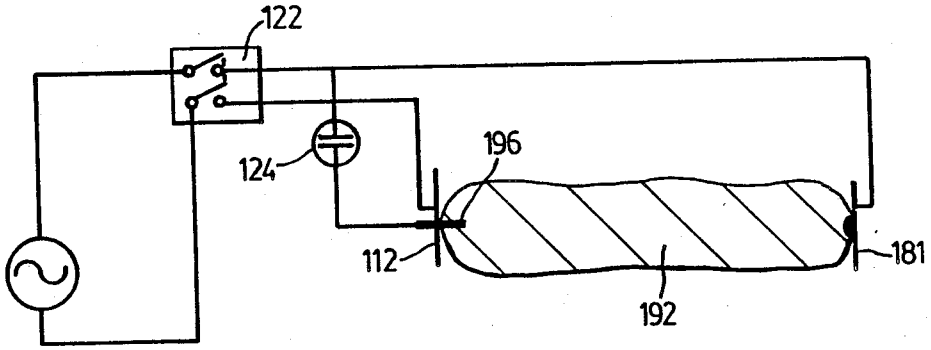
FIG. 10 is an electrical circuit diagram for the second embodiment of this invention.

Returning to FIG. 5, the bottom molding 84 is shaped to define, along each lateral side, an outside wall 165 and an inside wall 167 which is parallel with but spaced from the outside wall 165. See FIG. 11.

Lodged between the walls 165 and 167 is a freely movable elongated member 170 which is integral with a head 172 at the leftward end in FIG. 5, the head 172 defining a lateral flange 174 which is adapted to cooperate with the safety switch 122. At the rightward end of the member 170 as seen in FIG. 5, there is an integral lateral tab 176.

The axle 149 has an integral cam member 178, which in elevation has the shape shown in FIG. 7. When the axle 149 is in the FIG. 5 position, corresponding to FIG. 4 in which the lid 82 is open, the cam member 178 is located in a position 90° clockwise from the position of FIG. 7, which allows the member 170 to move to its furthest rightward position as seen in FIG. 5. However, as the axle 149 begins to rotate due to the closing of the lid 82, the cam member 178 gradually swings counterclockwise through 90° to take up the FIG. 7 position, simultaneously causing the member 170 to be urged leftwardly such that the flange 174 can push the actuator 180 of the safety switch 122 leftwardly. This closes the switch 122, and energizes the various portions of the cooker, as will be subsequently explained.

Mounted on the forward wall 130 of the carriage 126 is a further electrically conductive contact plate 181 which is provided with four protuberances 183, similar to the protuberances 114–117. The protuberances 183 are all aligned with the various troughs defined by the guide member 88.

Turning now to the electrical circuit, with reference to FIG. 5, power is received from a standard 120 volt service through wires 185 and 186, which lead to the safety switch 122. When the actuator 180 of the safety switch 122 is in its furthest rightward position (as seen in FIG. 5), the safety switch is off and no power is fed to the various portions of the cooker. However, when the safety switch 122 is turned on due to leftward movement of the member 170, in turn due to the rotation of the axle 149 as the lid 82 closes, the two wires 185 and 186 are connected with wires 188 and 189, respectively. As can be seen in FIG. 5, the wire 188 passes along the channel between the outside wall 167 and the inside 165 (on the side opposite from the member 170), and is connected electrically with the plate 181 on the movable carriage 126. The other wire 189 is connected to the contact plate 12. Thus, when the lid 82 is closed, and the unit is plugged into the wall, the plates 112 and 181 become "live".

At the same time, the closing motion of lid 82 causes the carriage 126 to be pushed to its furthest leftward position by the springs 144, this position being determined by the length of sausages or frankfurters 192 which may have been placed in the various troughs defined by the guide member 88. FIG. 6 shows this position of contact, and it will be understood that the sausages or frankfurters 192 are effectively placed across the wall voltage of 120 volts. As is well known from the prior art, the application of wall voltage across food items of this kind causes current to flow, such that the inherent resistance of the sausages, etc. gives rise to the production of heat, which in turn cooks the sausage. Looking to the right in FIG. 6, it will be seen that, when the unit is in the "on" position, the spring holder 138 has moved some distance to the left, and that the carriage 126 has moved a greater distance to the left. However, if longer sausages 192 were placed into the unit, the carriage 126 would take up a different position, somewhat to the right of the FIG. 6 position as illustrated.

The electrical circuitry includes a warning or indicator light in the form of the light bulb 124. The bulb is a neon bulb, and it is wired in series with the conventional protective resistance 194. This series connection is in electrical contact with the wire 188, and with a probe 196 which penetrates one of the sausages 192 without being in contact with the contact plate 112. As can be seen, the protuberance 116 has had its central portion removed, to allow the probe 196 to pass through it. However, no contact is made between the probe 196 and the modified protuberance 116.

In operation, so long as there is a sausage 192 in a position to be pierced by the probe 196, the neon bulb 124 will light as soon as power is applied between the plates 112 and 181. As is known, a neon bulb will fire only at voltages above approximately 67 volts. The pierced sausage completes a circuit between the wire 188 and wire 189, the later being connected to the protuberance 116. Thus, a very short portion of the respective sausage 192 takes part in this electric circuit. When the plates 112 and 181 are first energized, the sausage is as yet uncooked, and has a good quantity of contained liquid. As a result, the resistance of the sausage 192 is initially quite low, thus causing the neon bulb 124 to "see" a voltage which is higher than its firing voltage. However, as the sausage cooks, the liquids, greases, etc. are driven off, thus raising its resistance. This will lower the resistance "see" by the neon bulb 124, and when the applied voltage across the bulb drops below the firing voltage, the bulb will no longer fire. The extinction of the bulb 124 is thus a signal to the user that the sausages are cooked.

While two embodiments of this invention have been illustrated in the accompanying drawings and described hereinabove, it will be evident to those skilled in the art that changes and modifications may be made therein without departing from the essence of this invention, as set forth in the appended claims.

The embodiments of the invention in which an exclusive. property or privilege is claimed are defined as follows:

1. An electric cooker for sausages and the like, comprising:

a base portion which includes support means for supporting at least one sausage-like item so that the latter is restrained against lateral deflection when axially compressed, said support means being electrically non-conduction, said support means being shaped to define at least one rounded trough into which a sausage-like item can be placed, first electrically conductive contact means adjacent one end of said at least one sausage-like item, second electrically conductive contact means adjacent the other end of said at least one sausage-like item, one of said contact means being movable toward and away from the other, to allow the contact means to simultaneously contact the respective ends of a sausage-like item in the support means, each said conductive contact means being a metallic plate having at least one raised protuberance substantially in axial alignment with said at least one trough, a carriage adapted to reciprocate in a direction aligned with said at least one trough, the movable plate being mounted on said carriage, electrical means for passing electrical current between the two plates through said at least one sausage-like item, thereby heating the item due to the item's internal resistance, an on-off switch connected with said electrical means such that when the switch is off no electrical current can flow between the two plates, and such that when the switch is on current can flow between the two plates;

a lid hinged to the base portion and adapted to swing between an open position and a closed position, the lid being operatively connected with said switch and with one of said plates such that 1) when the lid is in the open position, a sausage-like item may be inserted into or removed from the support means and said switch is off, and 2) when the lid is in the closed position, physical access to a sausage in the support means is prevented and the switch is on, and resilient means biasing the carriage toward the non-movable plate, the lid being operatively connected with said carriage by cam and follower means such that, as the lid moves from its open toward its closed position, the carriage is permitted to move toward the non-movable plate under the urging of the spring means, to achieve a final position dependent upon the length of the sausage-like item, and as the lid moves from its closed toward its open position, the carriage is retracted away from the non-movable plate against the urging of said spring means, said electrical means being adapted to draw power from a conventional alternating current source, the electric cooker further including an indicator light circuit comprising a neon bulb, a conductive probe and a protective resistance all wired in series and connected to one side of the alternating current source, the conductive probe being adapted to penetrate into a sausage-like item in the support means to make electrical contact with said item, the circuit being completed to one of said plates by a portion of said last-mentioned sausage-like item, whereby when current is first applied to the sausage-like item, the internal resistance of the latter is low enough to ensure that the voltage drop across the bulb will be high enough to fire the bulb, and when the sausage-like item is cooked, the internal resistance thereof rises to the level necessary to lower the voltage across the bulb below the firing threshold, whereby the bulb turns off when the cooking is completed.

2. The electric cooker claimed in claim 1, in which the resilient means comprises at least one spring.

3. The electric cooker claimed in claim 1, in which the probe is positioned closely adjacent the non-movable plate but out of electrical communication therewith, whereby only a relatively small portion of the respective sausage-like item takes part in the indicator light circuit.

4. The electric cooker claimed in claim 1, in which the support means is shaped to define a plurality of rounded aligned troughs into each of which a sausage-like item can be placed.

* * * * *